US005440896A

United States Patent [19]

Maier-Laxhuber et al.

[11] Patent Number: 5,440,896

[45] Date of Patent: Aug. 15, 1995

[54] APPARATUS FOR COOLING A MEDIUM WITHIN A CONTAINER

[76] Inventors: Peter Maier-Laxhuber, Saumweberstr. 14, D-8000 Munchen 60; Jorn Schwarz, Josef-Zintl-Str. 6 a, D-8000 Munchen 50; Edgar R. F. Winter, Fontaneweg 4, Neu-Esting, D-8037, Olching; Josef Soltes, Luisenstr. 60 A, D-8000 Munchen 40, all of Germany

[21] Appl. No.: 274,235

[22] Filed: Jul. 13, 1994

Related U.S. Application Data

[63] Continuation of Ser. No. 978,319, Nov. 18, 1992, abandoned.

[30] Foreign Application Priority Data

Nov. 19, 1991 [DE] Germany ..... 41 38 114.9

[51] Int. Cl.[6] ..... F25B 19/00

[52] U.S. Cl. ..... 62/269; 62/457.9; 62/457.4

[58] Field of Search ..... 62/269, 294, 100, 457.9, 62/457.4

[56] References Cited

U.S. PATENT DOCUMENTS

| | | | |
|---|---|---|---|
| 734,748 | 7/1903 | Randall | 62/269 |
| 1,001,460 | 8/1911 | Schou | 62/269 |
| 4,656,838 | 4/1987 | Shen | 62/294 |
| 4,752,310 | 6/1988 | Maier-laxhuber et al. | 62/269 |

FOREIGN PATENT DOCUMENTS

| | | | |
|---|---|---|---|
| 803813 | 6/1935 | France | 62/269 |
| 223 | of 1887 | United Kingdom | 62/269 |
| 3555 | of 1891 | United Kingdom | 62/269 |

*Primary Examiner*—John M. Sollecito
*Attorney, Agent, or Firm*—Hoffman & Baron

[57] ABSTRACT

Apparatus for cooling a medium within a container includes a container having a chamber with a medium to be cooled located therein. The container being capable of transferring heat energy from an interior surface of the container wall to an exterior surface. The apparatus also includes an evaporation unit having liquid operating medium which is in contact with the exterior surface of the container and a sorption medium container containing sorption medium coupled to the evaporation unit. The sorption medium unit being capable of adsorbing and desorbing operating medium vapor provided by the operating medium. When the liquid operating medium evaporates and is adsorbed by the sorption medium, additional operating medium evaporates causing the operating medium temperature to decrease. When the temperature of the liquid operating medium falls below the temperature of the liquid medium within the container, heat energy is transferred through the container wall from the liquid medium to the operating medium, causing the temperature of the container medium to decrease.

7 Claims, 3 Drawing Sheets

APPARATUS FOR COOLING A MEDIUM WITHIN A CONTAINER

This is a continuation of application Ser. No. 07/978,319 filed on Nov. 18, 1992 now abandoned.

BACKGROUND OF THE INVENTION

1. Field of the Invention

The present invention relates to an apparatus and method for cooling a medium within a container.

2. Description of the Prior Art

Cooling methods and apparatus, such as German Patent No. DE 31 25119, which operate in accordance with the sorption principle are generally known. In such devices and methods, a liquid is evaporated from an aqueous solution and the vapor is adsorbed by a sorption medium. As a result, the portion of the aqueous solution which remains in liquid form cools, while the sorption medium filler is heated. This method is generally performed in closed systems, whereby a vacuum pressure is provided and maintained so as to let the aqueous solution continue to evaporate even at relatively cool temperatures. The cooling devices which operate in accordance with the sorption principle are relatively inflexible in their application because they preferably operate in a closed system. Therefore, the medium being cooled must always be air tight connected to the cooling apparatus.

German Patent No. DE 40 03 107 discloses an icemaker which operates in accordance with the sorption principle. This patent teaches freezing an aqueous liquid in an icing container by utilizing a vacuum sorption container that has a solid sorption substance therein and to which a vacuum pump is connected. This icemaker is used for making ice from water, which can then be provided to a separate drinking glass for cooling of the liquid medium therein. Hence, a direct cooling of the container which stores the liquid is not disclosed by this patent.

The discharge of cooling devices that are filled with gaseous chlorinated hydrocarbons (CFC's) is routinely performed by means of a cartridge that contains activated carbon which absorbs the chlorinated hydrocarbon gas. More commonly used methods operate in accordance with a cold evaporation method wherein the device to be discharged is evacuated by means of a customary cold medium condenser. The condensed and liquified cold medium is then provided into a container for transport. The prior art systems are disadvantageous because they tend to include a bulky, complicated structure which is also relatively heavy.

In view of the above, it is desirable to provide a cooling device which does not exhibit the disadvantages associated with chlorinated hydrocarbon-cooling devices as well as to overcome the present inability of cooling a medium within a container without the use of a device which operates in accordance with the cold evaporation process.

OBJECTS AND SUMMARY OF THE INVENTION

It is an object of the present invention to provide a cooling method and relatively compact device wherein a large cooling capacity with relatively low effort of volume may be obtained in a short time period.

It is a further object of the present invention to provide apparatus and method for cooling a medium within a container which overcomes the inherent disadvantages of known cooling apparatus and methods.

In accordance with one form of the present invention, apparatus for cooling a medium within a container includes a container having an interior chamber with a medium to be cooled located therein. The chamber being defined by the walls of the container which are capable of transferring heat energy from an interior surface of the container wall to an exterior surface of the container wall.

The apparatus also includes an evaporation unit having a liquid operating medium therein. The liquid operating medium is in contact with the exterior surface of the container so that heat energy can be transferred from the medium located within the container, through the container wall, to the liquid operating medium. A sorption medium container, having sorption medium therein, is coupled to the evaporation unit. The sorption medium is capable of adsorbing and desorbing operating medium vapor generated by the liquid operating medium. When the operating medium evaporates and is adsorbed by the sorption medium, additional liquid operating medium will evaporate to maintain a relatively constant internal pressure. The additional evaporation causes more heat energy to leave the liquid operating medium thereby reducing the temperature of the operating medium. When the temperature of the operating medium falls below the temperature of the medium which is within the container, heat energy is transferred through the container wall from the liquid medium to the operating medium, causing the temperature of the liquid medium to decrease.

The method of the present invention for utilizing a cooling apparatus having an evaporation unit and a sorption container for cooling a liquid medium located within the chamber of a container includes generating a vacuum pressure within the cooling apparatus, providing operating medium vapor from the evaporation unit to the sorption medium container and absorbing the same. Thereafter, heat energy is released from the liquid medium through the container wall to the operating medium.

These and other objects, features and advantages of this invention will be apparent from the following detailed description of the illustrative embodiments thereof, which is to be read in connection with the accompanying drawings.

DETAILED DESCRIPTION OF THE PREFERRED EMBODIMENT

Figure 1:
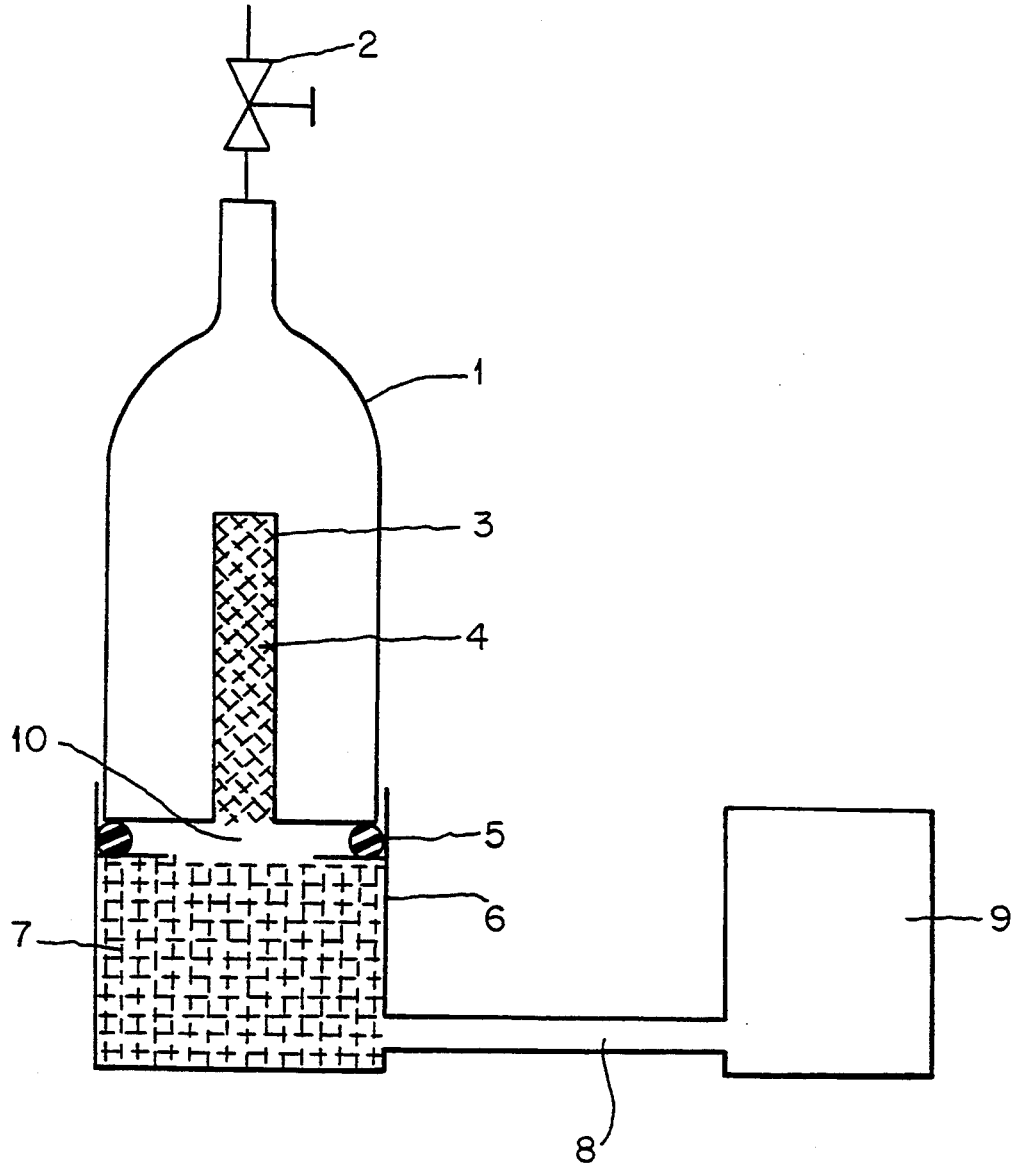
FIG. 1 is a cross-sectional view of a device for cooling a medium within a container constructed in accordance with one form of the present invention having an evaporation unit integrated therein.

Referring now to FIG. 1, apparatus for cooling a medium within a container constructed in accordance with the present invention will now be described. The cooling apparatus includes a liquid medium container 1 with a filling valve 2. The container includes a hollow exterior chamber 3 containing an absorption-like material 4. The hollow exterior chamber 3 has an opening which permits the chamber to be accessible as shown in FIG. 1. Preferably, the liquid medium container 1 is connected to an adsorption medium container 6 by means of a sealing ring 5. The adsorption medium container 6, having adsorption medium 7 therein, has a vacuum pump 9 coupled thereto by vacuum line 8. As a result, a vacuum pressure can be generated within the adsorption medium container 6. The adsorption medium container 6 is provided with an opening 10 in one wall of the container. Preferably, the liquid medium container 1 and adsorption medium container 6 are operatively air-tight coupled by sealing ring 5 so that the opening of the hollow exterior chamber 3 and opening 10 of the adsorption medium container 6 may communicate as shown in FIG. 1. In a preferred embodiment, the opening 10 is covered with an air-tight material before use in order to prevent the adsorption medium 7 from receiving liquid vapor before being coupled to the container 1 by sealing ring 5. The absorption-like material 4 contained within hollow exterior chamber 3 is preferably saturated with water before being coupled to container 1 by sealing ring 5.

Figure 2:
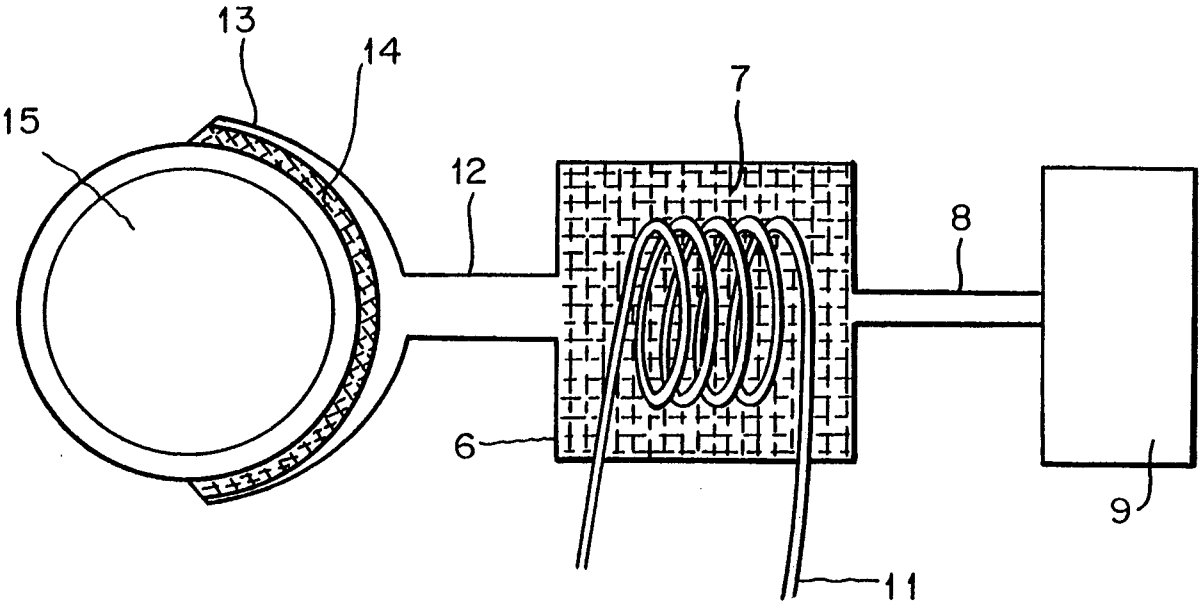
FIG. 2 is a top plan view of a device for cooling a medium within a container constructed in accordance with a second form of the present invention having a flexible evaporation unit.

Referring now to FIG. 2 of the drawings, an alternative form of the present invention is shown. The cooling apparatus of FIG. 2 includes vacuum pump 9 coupled to adsorption medium container 6 by means of vacuum line 8. The adsorption medium container 6 has adsorption medium 7 and an electric heater 11 therein. The adsorption container 6 is coupled to a flexible evaporator unit 13 by operating medium vapor line 12. Preferably, the operating medium vapor line 12 is made of a flexible material so that line 12 can be easily manipulated when connected to evaporator unit 13. Flexible evaporator unit 13 contains an absorption-like material 14, such as a sponge-like material, which is in good heat contact with a portion of the exterior surface of a container or beverage can 15. Preferably, the flexible evaporator unit 13 is securely attached to the exterior surface of the can 15 so that air does not flow therebetween. This can be accomplished by providing a vacuum pressure with vacuum pump 9 so that the beverage can 15 is pulled against the absorption-like material 14.

Figure 3:
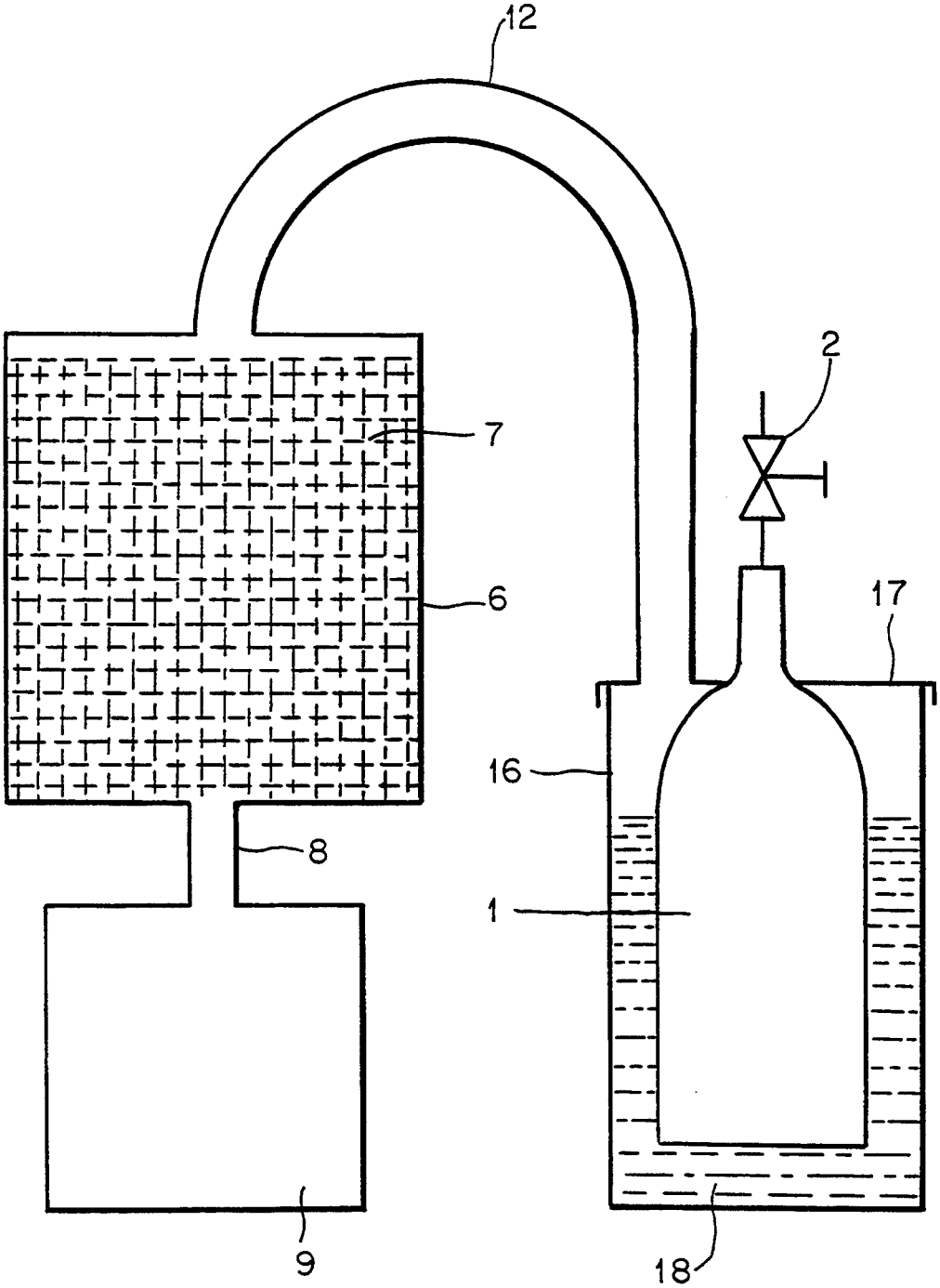
FIG. 3 is a cross-sectional view of a device for cooling a medium within a container constructed in accordance with a third form of the present invention wherein the container is partially enclosed within an evaporator unit.

Referring now to FIG. 3 of the drawings, an alternate form of the cooling device of the present invention is disclosed. The cooling apparatus shown in FIG. 3 includes a liquid medium container 1 having a filling valve 2 for providing a liquid medium to the container 1 for cooling. The liquid medium container 1 is at least partly located within evaporation unit 16. The evaporation unit 16 is equipped with a removable lid 17 having a hole therethrough permitting the neck of the container 1 to extend outside of the evaporation unit. Adsorption medium container 6 having adsorption medium 7 therein is coupled to the evaporation unit 16 by flexible operating medium vapor line 12. Additionally, a vacuum pump 9 is coupled to the adsorption medium container by means of vacuum line 8. Due to the vacuum pressure created by vacuum pump 9, removable lid 17 is pressed air tight on the neck of the liquid medium container 1. The evaporation unit 16 has water 18 therein which surrounds and contacts portions of the exterior surface of the liquid medium container 1 which are located within the evaporation container.

The operation of the cooling apparatus of the present invention will now be described with reference to FIG. 1. Before attaching the liquid medium container 1 to the adsorption medium container 6 with sealing ring 5, the hollow exterior chamber 3 having adsorption-like material 4 therein is saturated with water or other suitable operating medium. Then, the container 1 may be filled with the liquid which is to be cooled by opening filling valve 2 and pouring the liquid therein. Thereafter, container 1 is attached to the adsorption medium container 6 so that opening 10 is adjacent to and can communicate with exterior hollow chamber 3. Then, vacuum pump 9 will create vacuum pressure in the adsorption medium container 6 causing water to evaporate from the absorption-like material 4. As a result and according to the sorption principle, this will cause the temperature of the water which remains in the absorption-like material to decrease. This decrease in temperature will be transferred through the container wall which contacts the absorption-like material to the liquid within the container. As a result, the temperature of the liquid within the liquid medium container 1 will decrease.

The operation of the cooling device shown in FIG. 2 operates in a manner similar to FIG. 1 except that a heating device 11 is included in the adsorption medium container. Since the cooling device is a closed system, the heating device 11 permits regeneration of the cooling capacity by expelling the operating medium that was absorbed by the absorption medium and forcing the operating medium into absorption-like material 14 for another cooling cycle.

The cooling device of FIG. 3 operates similarly to FIGS. 1 and 2 except that the evaporation container is filled with water or other operating medium 18 which surrounds and contacts the container 1 which is partially contained therein. When the vacuum pump is turned on, a vacuum pressure is created that causes evaporation of water 18, which in turn, reduces the temperature of water 18. As a result, the cold which has been generated is transmitted through the walls of container 1 to the liquid to be cooled.

The present invention permits a liquid medium to be cooled in the same container that it is stored in without the addition of ice or chemicals because heat energy is transferred through the walls of the container to the cooling device. It should also be understood that the term container, as used in the present invention, includes all receptacles which are suitable for receiving a liquid, solid or gas-like medium. For example the container may not only be a beverage can, beverage bottle, trough or pot, but it may also include pipeline systems, wherein liquid or gas-like media are contained or flow therein.

Furthermore, the term "container" also includes heating pipe networks, wherein hot water normally flows and supplies heat energy to radiators. However, there may come a time when a section of pipe is in need of repair. If this is true, the flow of water is stopped so that it becomes stagnant. Thereafter, a portion of the heated water may be cooled and frozen By removal of heat energy through the surface of the pipe. The frozen heating water then prevents the further flow of the heating water so that the section of heating pipe in need of repair can be repaired without emptying all of the water from the system.

The present invention also contemplates the use of containers which are specifically designed and modified for cooling a liquid in accordance with the present invention. For example, recesses may be provided on the inside or the outside surface of the container and filled with an aqueous solution which can evaporate as shown in FIG. 1. It is also possible to design the container in such a manner that it can be inserted into the evaporation unit without the need for any additional devices so that when a vacuum is applied, the system is airtight sealed. This is advantageous when a cooling container is filled with the liquid to be cooled after it has been connected to the cooling device.

In accordance with the present invention, relatively good heat transfer between the container wall and the aqueous solution can be obtained because the container is immersed, at least partially, into the aqueous liquid of the evaporator unit. It may also be advantageous to bring the container wall in contact with an absorption-like material that is wet with an aqueous liquid which serves as the operating medium. Particularly advantageous are materials which can be pulled over the outside of the container wall to fit securely thereover and which are subsequently saturated with water.

It may also be advantageous to at least partially construct the evaporator unit of flexible materials which adapt to the surface contours of the container, specifically during vacuum pressure. As a result, an airtight evaporator unit is provided can directly contact and conform to the surface contours of portions of the container wall. It is particularly advantageous to couple the flexible portion of the evaporator unit with the absorption-like material so that the absorption-like material will directly contact the container wall and provide cooling power. The evaporator unit may be held against the container wall by an artificial vacuum pressure. An example of a device which could be utilized to create such a vacuum pressure is a suction cup which is commonly used when handling panes of glass. In addition, care has to be taken to insure that there are sufficient flow conduits for the transfer of liquid operating medium vapor from the evaporator unit to the adsorption medium.

In the present invention, the vapor flowing from the evaporation unit is absorbed in the sorption medium filler. In particular, zeolites are suitable for use as the sorption filler medium since they can store up to 36% by weight of water and also release heat. Zeolites are in use in many areas of the sorption technology industry and, due to increasing synthetic production, they have become relatively economical. Furthermore, zeolites are advantageous because they have a regenerative quality in that they can release the adsorbed water if a supply of heat is provided. In order to maintain the required evaporation vacuum pressure, it is preferable to mount the sorption medium filler within a single sorption medium container.

The vacuum line 12 which is utilized to connect the adsorption medium container to the evaporation unit, may consist of a flexible hose, such the ones customarily used in connection with household vacuum cleaners. However, it is important that the hose cross section be large enough to permit the desired evaporation rate.

The sorption medium container of the present invention may also include a heating device such as an electrical heat conductor for heating the sorption medium within the container in order to desorb the operating medium which was previously adsorbed. It is also advantageous to design the sorption medium container in such a manner that the sorption medium filler can be removed from the container and replaced with fresh sorption medium. For defined application cases, it appears to be advantageous to mount the sorption medium filler into a disposable container which can be separated and disposed of after use.

It appears to also be advantageous to design the sorption medium container so that the desorption heat supplied to the sorption medium expelled to the environment through the sorption medium container wall. Particularly suitable are flat containers or pipes with a relatively small diameter.

The sorption medium filler should be mounted within the sorption medium container in such a manner that the operating medium vapor which flows therein from the evaporator unit can reach all portions of the sorption medium without a substantial loss in pressure.

During the sorption of operating medium vapor by the sorption medium, heat is provided which results in a heating of the sorption medium. As is known, adsorption medium at an elevated temperature can absorb noticeably less vapor than cool adsorption medium at the same steam pressure. Therefore, care should be taken to appropriately discharge the heat to the environment or to suitable heat absorbing media. In the alternative, the amount of adsorption medium filler can be selected to be sufficiently large so that the desired amount of cold can be generated without the need for substantial emission of the adsorption heat to the environment.

If a cooling device constructed in accordance with the present invention is not manufactured as a closed unitary system wherein the correspondingly required vacuum pressure is provided during assembly of the unit, it is required to evacuate the adsorption medium filler by means of a vacuum pump in order to produce the desired cold effect. For this purpose, a suitable vacuum pump is connected to the adsorption medium container in order to evacuate air and other non-condensable gases from the cooling device. Preferably, the internal vacuum pressure has to be generated in such a manner that the gases can be removed from all regions of the adsorption medium container. In contrast to the large diameter vacuum line which connects the evaporator unit to the adsorption medium container, the discharge vacuum line which couples the adsorption medium to the vacuum pump can have a relatively small diameter.

All commercially available vacuum pumps whose end pressure is somewhat lower than the evaporation pressure of the aqueous liquid at the desired evaporation temperature are suitable. For example, pure water has a steam pressure of 6.1 mbar at 0° C. In order to evaporate pure water at this temperature, the vacuum pump needs an end pressure of about 5 mbar.

Particularly suitable are oilfree vacuum pumps which, without discharging oil mists, can be installed completely independent of their location with respect to the cooling device. In this manner, a relatively simply constructed and economical system is available for providing cold beverages. In addition to the above-described cold medium bottle and vacuum pump, the present invention only requires an adsorption cartridge and flexible adapter in order to generate cold medium within a storage or dispensing bottle.

It is also particularly advantageous if all structural parts are separable from each other. In this manner, the evaporator unit, the adsorption medium container and the vacuum pump can be combined in any given manner. With a plurality of small adsorption medium containers, chlorinated hydrocarbons (CFC's) can be discharged from large cold medium plants. By a simple exchange of the evaporator unit, any given cold medium bottle may be coupled to the adsorption medium container.

Commonly used vacuum pumps have a 110 V connection. However, it is advantageous to utilize pumps which can be operated with 12-V or 24-V connections so that the cooling device can be used in a passenger car or truck. It is also possible to utilize manually operated vacuum pumps so long as the pump creates a sufficient vacuum pressure. As a result, camp grounds and other recreation areas can be equipped with the inventive cooling device.

When utilizing water as the operating medium, an ambient pressure of below 6.1 mbar is required for water to freeze. Therefore, only after the entire water volume is frozen can the temperature of the ice fall below 0° C. during a continued steam sublimation. If a cooling of the medium within the container below 0° C. is desired without freezing the water operating medium, it is recommended to add corresponding antifreeze agents to the operating medium. In addition, well known substances which lower the freezing temperature of the operating medium including salt are suitable. However, when utilizing antifreeze agents, care should be taken that the partial vapor pressure of liquid operating medium is below the vapor pressure of pure water operating medium.

Although illustrative embodiments of the present invention have been described herein with reference to the accompanying drawings, it is to be understood that the invention is not limited to those precise embodiments, and that various other changes and modifications may be effected therein by one skilled in the art without departing from the cope or spirit of the invention.

What is claimed:

1. Apparatus for cooling a medium located within a chamber of a container defined by a container wall, the container wall having interior and exterior surfaces, the chamber being defined by the interior surface of the container wall, the medium being located within the chamber and in contact with the interior surface, the container wall providing means for transferring heat energy from the interior surface to the exterior surface, the apparatus comprising:

an evaporation unit having liquid operating medium therein and a connection port, the exterior surface of the container being in contact with the liquid operating medium of the evaporation unit, a sorption medium container having at least first and second connection ports and sorption medium therein, the sorption medium being capable of adsorbing and desorbing the liquid operating medium vapor, the container being oriented over the sorption medium container such that the connection port of the evaporation unit and a portion of the exterior surface of the container are disposed adjacent and operatively coupled to the first connection port of the sorption medium container, vacuum means, the vacuum means being coupled to the second connection port of the sorption medium container such that sorption medium is interposed between the point at which the evaporation unit and sorption medium container are coupled and the point at which the vacuum means and the sorption medium container are coupled, the vacuum means providing means for drawing evaporated liquid operating medium down and through the sorption medium, wherein when a portion of the liquid operating medium evaporates, the liquid operating medium vapor is absorbed by the sorption medium causing the temperature of the liquid operating medium to decrease, and wherein heat energy is transferred from the medium within the container to the container wall, the operating medium absorbing the heat energy from the container wall so as to lower the temperature of the medium within the container.

2. Apparatus for cooling a medium located within a chamber of a container as defined by claim 1 wherein the evaporation unit is contained within an exterior chamber of the container.

3. Apparatus for cooling a medium located within a chamber of a container as defined by claim 2 wherein the liquid operating medium is bound in an absorption-like material having a surface which engages at least a portion of the exterior surface of the container.

4. Apparatus for cooling a medium located within a chamber of a container as defined of claim 1 wherein the sorption medium is removable from the sorption medium container.

5. Apparatus for cooling a medium located within a chamber of a container as defined of claim 1 wherein the container to be cooled is a bottle into which a liquid medium may be enclosed.

6. Apparatus for cooling a medium located within a chamber of a container as defined of claim 1 wherein the evaporation unit is coupled to the sorption medium container in an air-tight manner.

7. Apparatus for cooling a medium located within a chamber of a container as defined by claim 1 wherein the sorption medium is zeolite.

* * * * *